United States Patent [19]

Takada

[11] 4,395,203

[45] Jul. 26, 1983

[54] VANE COMPRESSOR HAVING A DISCHARGE RATE CONTROL

[75] Inventor: Haruhiko Takada, Konan, Japan

[73] Assignee: Diesel Kiki Co., Ltd., Tokyo, Japan

[21] Appl. No.: 247,780

[22] Filed: Mar. 26, 1981

[30] Foreign Application Priority Data

Mar. 29, 1980 [JP] Japan ..... 55-41074

[51] Int. Cl.[3] ..... F04B 49/06

[52] U.S. Cl. ..... 417/282; 417/292; 417/293; 417/441; 62/133

[58] Field of Search ..... 62/133, 228 C; 417/282, 417/292, 295, 298, 441, 293

[56] References Cited

U.S. PATENT DOCUMENTS 1,940,857 12/1933 Golladay et al. ..... 417/293
3,834,846 9/1974 Linder et al. ..... 418/270
4,330,999 5/1982 Nakayama ..... 417/295

FOREIGN PATENT DOCUMENTS 55-69787 5/1980 Japan ..... 417/295

*Primary Examiner*—Larry I. Schwartz
*Attorney, Agent, or Firm*—Frishauf, Holtz, Goodman & Woodward

[57] ABSTRACT

A vane compressor is provided with a discharge rate control device which comprises valve means arranged to close part of the fluid suction passage leading to the pump working chambers to vary the opening of the fluid suction passage, and valve driving means for controlling the valve means. The valve means may be formed of at least one valve disposed to close an associated one of the inlet ports opening in the pump working chambers. The discharge rate control device may be arranged to be operated as a function of the rotational speed of the rotor of the compressor or the temperature of fluid being sucked into the compressor, which makes it possible, for instance, to keep the refrigerating capacity of an air conditioning system associated with the compressor at a substantially constant value.

6 Claims, 6 Drawing Figures

VANE COMPRESSOR HAVING A DISCHARGE RATE CONTROL

BACKGROUND OF THE INVENTION

The present invention relates to a vane compressor adapted for use in air conditioning systems for automotive vehicles or like systems to compress a fluid such as a refrigerant.

A vane compressor for use in an air conditioner for automotive vehicles is already known, e.g. from U.S. Pat. No. 3,834,846 issued Sept. 10, 1974, which is of the type including a rotary shaft arranged to be rotated by an associated prime mover; a rotor secured to the rotary shaft for rotation in unison therewith, the rotor having a plurality of axial slits formed in its outer peripheral surface; a plurality of vanes radially movably received in the axial slits; and a housing within which the rotor and the vanes are accommodated, the rotor, the vanes and the housing cooperating to define pump working chambers between them, wherein a refrigerant pumping action is carried out by the rotation of the rotor.

According to the vane compressor of the above type, rotation of the rotor causes the volumes of the pump working chambers to increase for suction of refrigerant into them and decrease for compression of the sucked refrigerant.

The discharge rate, i.e., discharge amount per unit time of compressed refrigerant from the compressor of this type depends upon the r.p.m. of the rotor. More specifically, a decrease in the rotational speed or r.p.m. of the rotor causes a corresponding decrease in the discharge rate of compressed refrigerant, whereas an increase in the r.p.m. causes a corresponding increase in the above discharge rate. While the rotor is rotated at a constant speed, the discharge rate is kept at a substantially constant value. However, in an air conditioning system for automotive vehicles, usually the rotor of the refrigerant compressor is connected to an engine output shaft of the vehicle, on which the system is installed, for rotation in unison with the rotation of the engine output shaft. However, it goes without saying that the engine r.p.m. largely changes. Upon a change in the engine r.p.m., the discharge rate of the compressor changes correspondingly, to cause fluctuation of the refrigerating capacity of the air conditioning system, making it difficult to obtain a desired discharge air temperature. To avoid such change in the discharge rate of the compressor, it has been proposed to interpose speed regulating means between the engine output shaft and the rotor, to keep the rotational speed of the rotor substantially constant. However, such conventional constant speed regulating means are very complicated in structure and unsuitable for installment in an automotive vehicle due to their large sizes. Further, such regulating means are rather expensive.

OBJECTS AND SUMMARY OF THE INVENTION

It is an object of the invention to provide a vane compressor which is provided with a discharge rate control device which is simple in structure and which comprises at least one valve arranged to close part of the fluid suction passage of the compressor, which leads to the pump working chambers, wherein the opening of the above fluid suction passage can be varied by opening or closing the valve.

It is a further object of the invention to provide a vane compressor for use in an air conditioning system, which is provided with a discharge rate control device which is capable of varying the discharge rate of the compressor as a function of the r.p.m. of the rotor, so that, for instance, the refrigerating capacity of the air conditioning system can be kept at a substantially constant value irrespective of changes in the r.p.m. of the rotor.

It is another object of the invention to provide a vane compressor for use in an air conditioning system, which is provided with a discharge rate control device which is capable of varying the discharge rate of the compressor as a function of a factor representing the temperature of the fluid being sucked into the compressor, such as the temperature of air being discharged from the air conditioning system so that, for instance, the refrigerating capacity of the air conditioning system can be kept at a substantially constant value.

The above and other objects, features and advantages of the invention will be more apparent from the following detailed description taken in connection with the accompanying drawings.

BRIEF DESCRIPTION OF THE ACCOMPANYING DRAWINGS

and

Figure 6:
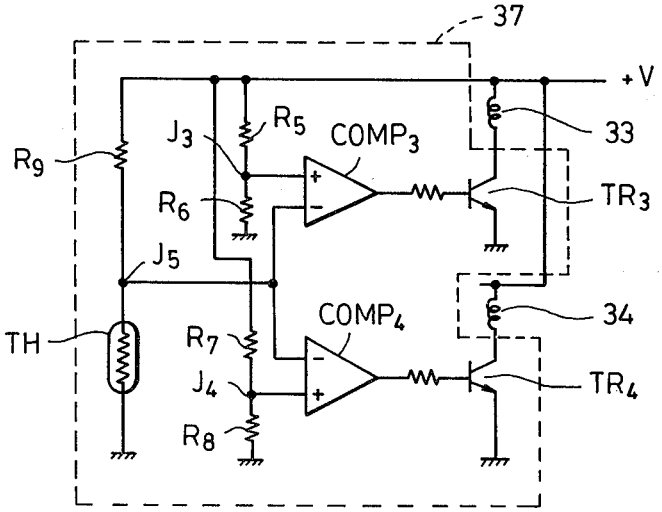

FIG. 6 is a circuit diagram showing another example of the discharge rate control means according to the invention.

DETAILED DESCRIPTION

Figure 1:
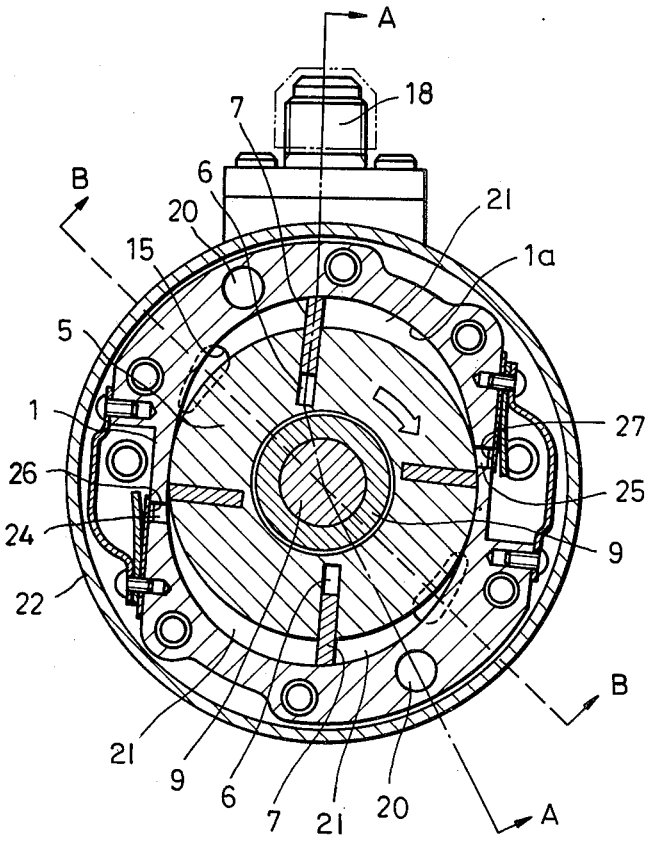
FIG. 1 is a cross sectional view of a vane compressor according to an embodiment of the invention.
Figure 2:
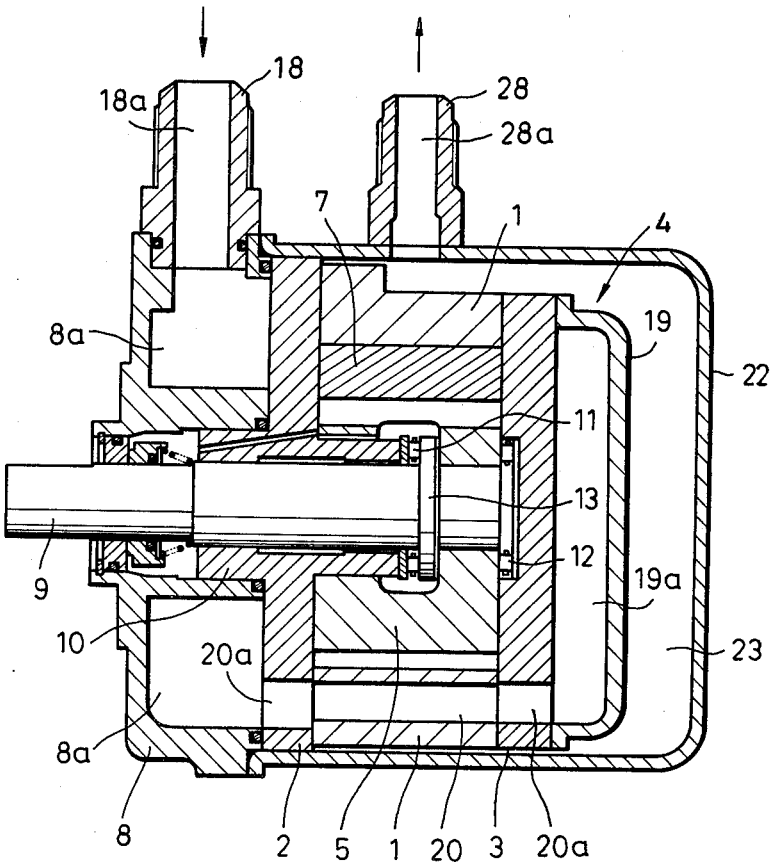
FIG. 2 is a sectional view taken on line A—A of FIG. 1.
Figure 3:
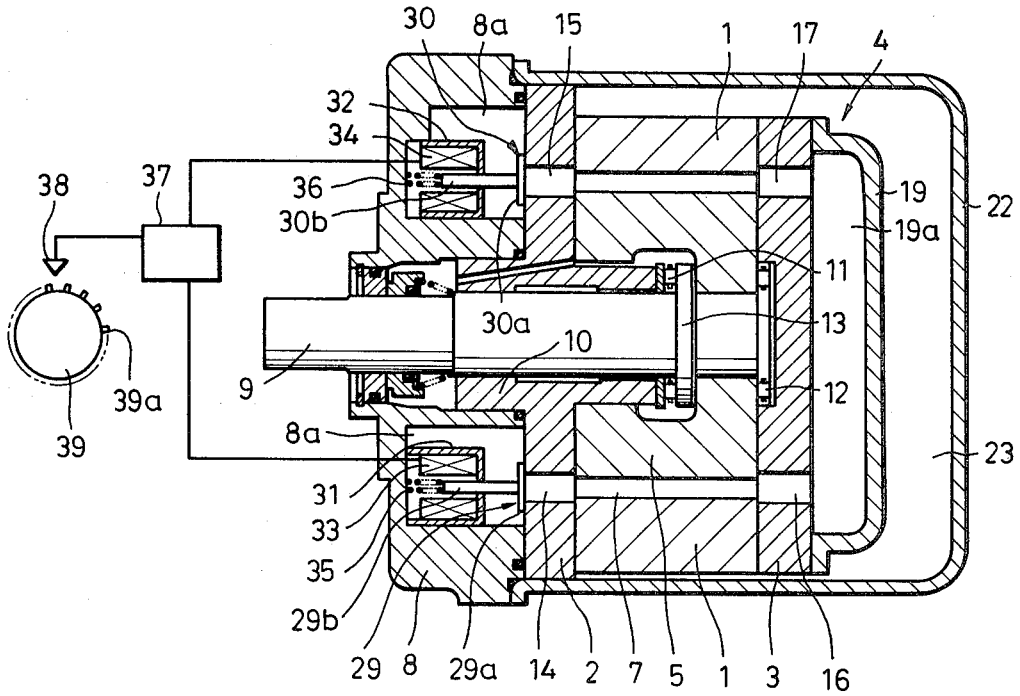
FIG. 3 is a sectional view taken on line B—B of FIG. 1.

FIGS. 1 through 3 illustrate a vane compressor according to an embodiment of the present invention, which is adapted for use in an air conditioning system for automotive vehicles, for compressing refrigerant circulating therein.

A cam ring 1, which has an oblong cross section along its camming inner peripheral surface, is combined at its opposite ends with two side blocks 2, 3 to form a pump housing 4 in cooperation therewith. A rotor 5 having a circular cross section is rotatably disposed within the pump housing 4. The rotor 5 has its outer peripheral surface formed with four axial slits 6 circumferentially spaced from each other with a phase difference of 90 degrees and radially opening in the outer peripheral surface, in which slits are received vanes 7.

The rotor 5 is fitted on and secured to a drive shaft 9 which extends through a front head 8 secured to a front end face of the side block 2 and the same side block 2. The drive shaft 9 has its top end fitted in and rigidly secured to the rotor 5 and has its intermediate portion rotatably supported on a bearing portion 10 formed integrally on the side black 2. The drive shaft 9 and the rotor 5 are supported on thrust bearings 11, 12 in the thrust load-applying directions. The thrust bearing 11 is interposed between the rotor 5 and a collar 13 radially outwardly projecting integrally from the drive shaft 9, and the other thrust bearing 12 between the side block 3 and the rotor 5, respectively, to support the rotor 5 so as to keep the gaps between the rotor 5 and the opposite side blocks 2, 3 at respective predetermined values, thus preventing the rotor 5 from being biased toward either of the side blocks 2, 3.

A magnetic clutch, not shown, is mounted on an outwardly projecting end of the drive shaft 9, which clutch is, on the other hand, connected to the output shaft of an automotive engine, not shown, or the like to transmit torque from the engine to the drive shaft 9.

The side blocks 2, 3 are formed with refrigerant inlet ports 14, 15, 16, 17 extending therethrough. The inlet ports 14, 15 formed in the side block 2 directly communicate pump working chambers 36 defined within the pump housing 4, hereinafter referred to, with an annular refrigerant suction space 8*a* formed within the front head 8, while the inlet ports 16, 17 formed within the side block 3 communicate the above-mentioned pump working chambers with the annular refrigerant suction space 8*a* by way of a suction chamber 19*a* formed within a partition member 19 secured to the side block 3 and communication bores 20, 20*a* axially extending through the side blocks 2, 3 and the cam ring 1. The refrigerant suction space 8*a* communicates with a suction port 18*a* formed within a suction connector 18 mounted on the front head 8.

A cover 22 having a cylindrical body is secured to the front head 8 in a manner enclosing the pump housing 4 to define a refrigerant delivery chamber 23 between the cover 22 and the pump housing 4.

The cam ring 1 is further formed with refrigerant outlet ports 24, 25 to communicate the pump working chambers defined within the pump housing 4 with the refrigerant delivery chamber 23 through discharge valves 26, 27 which are mounted on the outer peripheral surface of the cam ring 1 and disposed over the outlet ports 24, 25, respectively.

A discharge connector 28 is mounted on the cover 22 which has a discharge port 28*a* formed therein and communicating with the refrigerant delivery chamber 23.

Two discharge rate control valves 29, 30 are mounted within the refrigerant suction space 8*a* within the front head 8 and arranged opposite the inlet ports 14, 15 formed in the front side block 2. These valves 29, 30 each comprise a valve body 29*a*, 30*a* in the form of a plate disposed to close the inlet port 14, 15, and a rod 29*b*, 30*b* formed of a magnetic material and coupled integrally to the valve body 29*a*, 30*a*. Further arranged within the refrigerant suction space 8 are solenoids 33, 34 which are mounted on the inner wall of the front head 8 by means of support frames 31, 32 secured thereto. The rods 29*b*, 30*b* extend through the respective support frames 31, 32 are movably inserted into the respective solenoids 33, 34, and have their free ends urged toward the respective valve bodies 29*a*, 30*a*, respectively, by coil springs 35, 36 disposed at their ends in contact with the inner wall of the front head 8. The solenoids 33, 34 are electrically connected to an electronic control unit 37 to be supplied with driving electric current therefrom. A r.p.m. sensor 38 is connected to the electronic control unit 37, which sensor may be formed of an electromagnetic pickup which may be arranged opposite the peripheral surface of the output shaft 39 of an automotive engine, not shown, to which the drive shaft 9 is connected. The electromagnetic pickup 38 is adapted to produce a pulse each time each of protuberances 39*a* formed on the peripheral surface of the shaft 39 passes the pickup 38 and supply it to the electronic control unit 37.

Incidentally, the inlet ports 16, 17 formed in the rear side block 3 are not provided with control valves such as ones 29, 30 mentioned above, and therefore are always kept open.

The operation of the vane compressor according to the invention described above will now be described. When the drive shaft 9 is rotated by means of a prime mover such as an automotive engine, via the electromagnetic clutch, not shown, the rotor 5 is rotated in unsion with the drive shaft 9 so that a centrifugal force produced by the rotation of the rotor 5 urges the vanes 7 in the slits 6 radially outwardly to cause the vanes 7 to slide at their top ends against the inner peripheral surface of the cam ring 1.

Each time each vane 7 passes the inlet ports 14, 15, 16, 17 in the side blocks 2, 3, refrigerant is sucked into the pump working chambers 21 defined by the cam ring 1, adjacent vanes 7 and side blocks 2, 3, through the inlet ports 14, 15, 16, 17. The pump working chambers 21 increase in volume when they are on the suction stroke, to suck refrigerant, and decrease in volume when they are on the discharge stroke, to compress the refrigerant therewithin. The compressed refrigerant urgingly opens the discharge valves 26, 27 to be discharged into the refrigerant delivery chamber 23 through the outlet ports 24, 25. The compressed refrigerant thus discharged into the delivery chamber 23 is temporarily stored in the same chamber and then discharged into the refrigerating circuit, not shown, of the air conditioning system, through the discharge port 28*a*.

Figure 4:
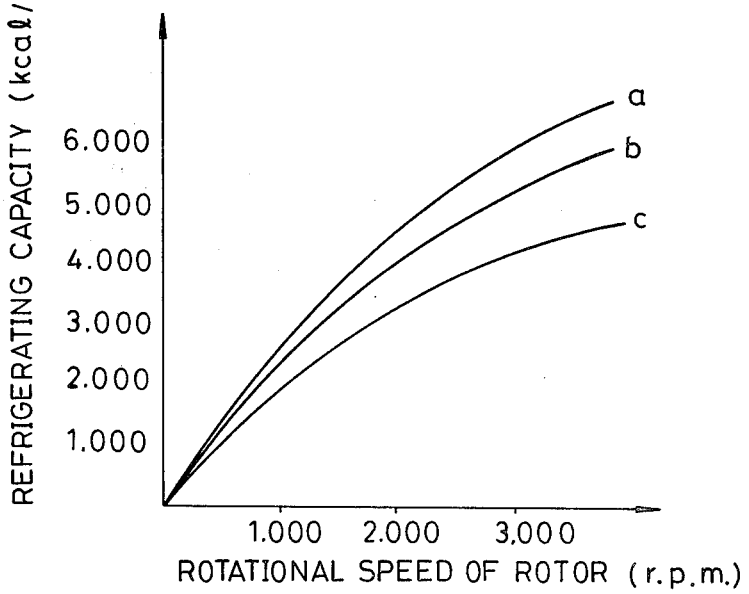
FIG. 4 is a graph showing the relationship between the refrigerating capacity of an air conditioning system employing a vane compressor according to the invention and the r.p.m. of the rotor used in the compressor.

According to the invention, it is possible to control the discharge rate of refrigerant by actuating one or both of the control valves 29, 30 to close one or both of their associated inlet ports 14, 15 to vary the rate at which the refrigerant is sucked into the pump working chambers. More specifically, when the valve 29 opens its associated inlet port 14, refrigerant is sucked through the same inlet port 14 and the inlet port 16 formed in the gear side block 3 into one of the pump working chambers in which the both ports 14, 16 opens, to obtain a higher refrigerant suction rate, and when the valve 29 closes the inlet port 14, refrigerant is sucked into the pump working chamber through the inlet port 16 alone, to obtain a lower refrigerant suction rate. The same relationship as mentioned above applies to the combination of the valve 30 with the inlet ports 15, 17. The refrigerant discharge rate which is achieved by the compressor is generally proportionate to the refrigerating capacity (kcal/h) of an air conditioning system in which the compressor is used. And, the refrigerating capacity of a conventional vane compressor in general is in such a relationship with respect to the r.p.m. of the rotor of the compressor as shown by the curve a in FIG. 4. FIG. 4 shows the refrigerating capacity of the air conditioning system relative to the r.p.m. of the rotor of the compressor which has a discharge capacity of 150 cc per revolution of the rotor, In FIG. 4, the characteristic indicated by the curve a is obtained when both of the valves 29, 30 are opened, which is substantially the same as that obtained by a conventional ordinary type vane compressor. According to this curve a, the refrigerating capacity varies generally in proportion to the r.p.m. of the rotor. The curve b represents a characteristic which is obtained when only one of the valves 29, 30 is closed, and the curve c a characteristic obtained when both of the valves 29, 30 are closed, respectively. It should be noted that the change of the refrigerating capacity is very small with respect to the change of the rotor r.p.m. as indicated by the curve c when the valves 29, 30 are both closed.

Therefore, in order to obtain a characteristic of refrigerating capacity which remains substantially constant with respect to the change of the rotor r.p.m., the energization of the solenoids 33, 34 should be controlled so that both of the valves 29, 30 are opened in a low r.p.m. range of the rotor 5, only either one of them is opened in an intermediate r.p.m. range of the rotor, and both of them are closed in a high rotor r.p.m. range.

The electronic control unit 37 is responsive to an r.p.m. signal from the r.p.m. sensor 38 to supply driving electric current to both of the solenoids 33, 34 to energize same when the engine or the rotor is in a low r.p.m. range, so that the rods **29*b*, 30*b* are displaced in the direction away from the inlet ports 14, 15 against the forces of the springs 35, 36, to cause the valve bodies 29*a*, 30*a* to move in unison therewith to open both of the inlet ports 14, 15. In an intermediate r.p.m. range, the unit 37 energizes only one of the solenoids 33, 34 to cause opening of only one of the inlet ports 14, 15, while in a high r.p.m. range the unit 37 does not energize either of the solenoids 33, 34 to keep both of the inlet ports 14, 15** closed.

Figure 5:
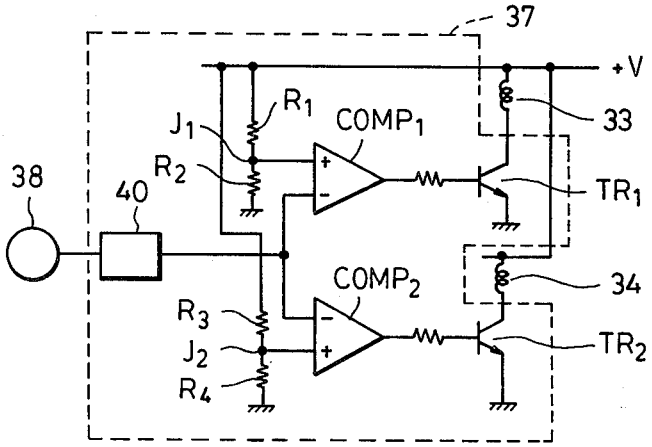
FIG. 5 is a circuit diagram showing an example of the discharge rate control means according to the invention.

FIG. 5 is a circuit diagram illustrating an example of the electronic control unit 37 in FIG. 3. The electronic control unit 37 includes two comparators $COMP_1$, $COMP_2$. The comparators $COMP_1$, $COMP_2$ have their non-inverting input terminals connected, respectively, to the junction $J_1$ of a resistance $R_1$ with a resistance $R_2$ and the junction $J_2$ of a resistance $R_3$ with a resistance $R_4$, the paired resistances $R_1$, $R_2$; $R_3$, $R_4$ being serially connected between a positive feeder and the ground. The comparators have their inverting input terminals connected to the r.p.m. sensor 38 in FIG. 3 by way of a D/A (digital-to-analog) converter 40. The values of the above resistances $R_1$, $R_2$, $R_3$, $R_4$ are so set that the voltage at the junction $J_1$ is lower than that at the junction $J_2$. The comparators $COMP_1$, $COMP_2$ have their output terminals connected, respectively, to the bases of NPN transistors $TR_1$, $TR_2$ which in turn have their collectors connected, respectively, to ends of the solenoids 33, 34 in FIG. 3, and their emitters grounded. Incidentally, the other ends of the solenoids 33, 34 are connected to the positive feeder.

With the FIG. 5 arrangement, the output pulses from the r.p.m. sensor 38 are converted into a DC voltage proportionate to the engine r.p.m. by means of the D/A converter 40, and the DC voltage is applied to the inverting input terminals of the two comparators $COMP_1$, $COMP_2$. In a low engine r.p.m. range, the output voltage from the D/A converter 40 is lower than the lower voltage at the junction $J_1$ of the resistance $R_1$ with the resistance $R_2$ so that the two comparators both produce binary outputs "1" to have both of the transistors $TR_1$, $TR_2$ conducting. Accordingly, the solenoids 33, 34 are both in an energized state to cause the rods **29*b*, 30*b* of the valves 29, 30 to be biased leftward in FIG. 3 against the forces of their respective springs 35, 36 to open their respective inlet ports 14, 15, thus to obtain a high discharge rate of refrigerant which corresponds to a portion of the curve a available in a low rotor r.p.m. range in FIG. 4**.

In an intermediate engine r.p.m. range, the output voltage from the D/A converter 40 exceeds the voltage at the junction $J_1$ of the resistance $R_1$ with the resistance $R_2$ but is still lower than the voltage at the junction $J_2$ of the resistance $R_3$ with the resistance $R_4$ so that the comparator $COMP_1$ now produces a binary output "0" while the other comparator $COMP_2$ still produces a binary output "1." Accordingly, the solenoid 33 alone becomes deenergized so that the rod **29*b* of the valve 29 is displaced rightward in FIG. 3 against the force of the spring 35 to cause the valve body 29*a* to close the inlet port 14. On the other hand, the output of the comparator $COMP_2$ being still "1" as noted above, the valve 30 remains in a position to open the inlet port 15. Therefore, a refrigerating capacity can be obtained which corresponds to a portion of the curve b available in an intermediate rotor r.p.m. range in FIG. 4**.

In a high engine r.p.m. range, the output voltage of the D/A converter 40 exceeds both of the voltages at the junctions $J_1$, $J_2$ so that the outputs of the comparators $COMP_1$, $COMP_2$ are both "0" to cause deenergization of the solenoids 33, 34 with the valves 29 30 closing the inlet ports 14, 15. Therefore, a low value of refrigeranting capacity is obtained which corresponds to a portion of the curve c available in a high rotor r.p.m. range in FIG. 4.

In the above-mentioned manner, the refrigerating capacity of the air conditioning system can be controlled at a substantially constant value irrespective of changes in the r.p.m. of the engine, i.e., the rotor.

FIG. 6 illustrates an example of discharge rate control means which is adapted to control the discharge rate of the compressor as a function of the temperature of fluid being sucked into the compressor of the present invention, which can actually be represented, for instance, by the discharge air temperature of the air conditioning system. The arrangement of FIG. 6 is distinguished from the arrangement of FIG. 5 in that two comparators $COMP_3$, $COMP_4$ are provided which have their inverting input terminals connected to the junction J5 of a resistance $R_9$ with a thermistor TH, the resistance $R_9$ and the thermistor TH superseding the r.p.m. sensor 38 and the D/A converter 40 in FIG. 5, the resistance $R_9$ and the thermistor TH being serially connected between the positive feeder and the ground. In FIG. 6, the resistance $R_5$–$R_8$ and the transistors $TR_3$, $TR_4$ are connected to the comparators $COMP_3$, $COMP_4$ and the solenoids 33, 34 in an arrangement substantially identical with that of the resistances $R_1$–$R_4$ and the transistors $TR_1$, $TR_2$ in FIG. 5. The thermistor TH, which has a negative temperature coefficient, is disposed so as to detect a temperature representing the temperature of fluid being sucked into the compressor, for instance, it can be mounted on the evaporator, not shown, of an associated air conditioning system to detect the temperature of air being discharged therefrom. The values of the resistances $R_5$–$R_8$ are set such that the voltage at the junction $J_3$ of the resistance $R_5$ with the resistance $R_6$ is lower than that at the junction $J_4$ of the resistance $R_7$ with the resistance $R_8$.

With the FIG. 6 arrangement, when the discharge air temperature of the evaporator is low, that is, the discharge air temperature of the air conditioning system for instance is low and accordingly the internal resistance of the thermistor TH is high enough to have the voltage at its junction $J_5$ with the resistance $R_9$ higher than the higher voltage at the junction $J_4$, the comparators $COMP_3$, $COMP_4$ both produce binary outputs "0" to cause both of the valves 29, 30 to close their respective inlet ports 14, 15 in the arrangement of FIG. 3, in the same manner described with reference to FIG. 5. With an increase in the discharge fluid or air temperature and a corresponding decrease in the internal resistance of the thermistor TH, the voltage at the junction $J_5$ becomes lower than that at the junction $J_4$ but still higher than that at the junction $J_3$ so that the output of the comparator $COMP_4$ alone becomes "1" to cause the valve 30 to open the inlet port 15, while the valve 29 keeps the inlet port 14 closed, in the arrangement of FIG. 3. With a further increase in the temperature, the voltage at the junction $J_5$ drops below the lower voltage at the junction $J_3$ to render the outputs of the two comparators $COMP_3$, $COMP_4$ "1" so that the valves 29, 30 both open the inlet ports 14, 15, thus obtaining a high value of refrigerating capacity.

In the above-mentioned manner, it is also feasible to control the refrigerating capacity by means of feedback of the temperature of fluid being sucked into the compressor as represented by the discharge air temperature of the air conditioning system, so as to keep the refrigerating capacity at a substantially constant value.

Although two control valves 29, 30 are provided for closing the inlet ports opening in the pump working chambers according to the embodiment illustrated in FIG. 3, the number of the control valves are not limited to two, but any number of such control valves may be employed, as the case may be. Further, in the same embodiment, the valves 29, 30 are arranged opposite the inlet ports 14, 15 formed in the side block 2. However, the location of such valves is not limitative, but the structure and location of such valves are optional so far as the valves are adapted and disposed to close part of the refrigerant suction passage leading to the pump working chambers 21.

While preferred embodiments of the invention have been described, variations thereto will occur to those skilled in the art within the scope of the present inventive concepts which are delineated by the following claims.

What is claimed is:

1. In a vane compressor including: a rotary shaft; a rotor rotatably fitted on and secured to said rotary shaft, said rotor having an outer peripheral surface thereof formed with a plurality of axial slits; a plurality of vanes radially movably received in said axial slits; a housing within which said rotor and said vanes are accommodated, said rotor, vanes and housing cooperating with each other to define pump working chambers therebetween; and a fluid suction passage communicating with the pump working chambers to guide fluid thereinto from the outside of said compressor; wherein rotation of said rotor which takes place in unison with rotation of said rotary shaft causes a pumping action of said fluid;

the improvement which comprises:

valve means disposed to close part of said fluid suction passage for controlling the rate at which said fluid is introduced into said pump working chambers;

valve driving means coupled to said valve means for controlling the closing action of said valve means;

a sensor disposed to detect the rotation rate (r.p.m.) of said rotor;

and electronic control means coupled to said sensor and to said valve driving means and being responsive to an output of said sensor for controlling the operation of said valve driving means, said electronic control means controlling said valve driving means to drive said valve means so as to vary the opening of said part of said fluid suction passage, as a function of a value of the rotation rate (r.p.m.) of said rotor detected by said sensor.

2. In a vane compressor including: a rotary shaft; a rotor rotatably fitted on and secured to said rotary shaft, said rotor having an outer peripheral surface thereof formed with a plurality of axial slits; a plurality of vanes radially movably received in said axial slits; a housing within which said rotor and said vanes are accommodated, said rotor, vanes and housing cooperating with each other to define pump working chambers therebetween; and a fluid suction passage communicating with the pump working chambers to guide fluid thereinto from the outside of said compressor; wherein rotation of said rotor which takes place in unison with rotation of said rotary shaft causes a pumping action of said fluid;

the improvement which comprises:

valve means disposed to close part of said fluid suction passage for controlling the rate at which said fluid is introduced into said pump working chambers;

valve driving means coupled to said valve means for controlling the closing action of said valve means;

a temperature sensor disposed to detect a temperature representing the temperature of fluid being sucked into said compressor; and electronic control means coupled to said temperature sensor and to said valve driving means and being responsive to an output of said temperature sensor for controlling the operation of said valve driving means, said electronic control means controlling said valve driving means to drive said valve means so as to vary the opening of said part of said fluid suction passage, as a function of a value of said temperature detected by said temperature sensor.

3. The vane compressor as claimed in claim 1 or 2, wherein:

said housing comprises a cam ring having a predetermined cross section along a camming inner peripheral surface thereof; and first and second side blocks secured to said cam ring at opposite ends thereof;

said fluid suction passage comprises a plurality of fluid inlet ports formed in said first and second side blocks in communication with said pump working chambers; and said valve means comprises at least one valve disposed to close at least one of said plurality of fluid inlet ports.

4. The vane compressor as claimed in claim 3, wherein:

said plurality of valves each comprise a valve body disposed to close one of said fluid inlet ports formed in one of said first and second side blocks; and a rod formed of a magnetic material and secured integrally to said valve body; and said valve driving means comprises at least one solenoid;

said valve body and said rod are being displaceable relative to an associated one of said solenoids in response to energization of said associated solenoid, to open or close said one fluid inlet port.

5. The vane compressor as claimed in claim 4, including a head secured to said one side block, said head having an internal space forming part of said fluid suction passage, said valves and said at least one solenoid being arranged within said internal space.

6. The vane compressor as claimed in claim 5, including a partition member secured to the other one of said first and second side blocks and defining a refrigerant suction chamber therebetween, said inlet ports formed in said other side block opening in said refrigerant suction chamber, said first and second side blocks and said cam ring are being formed with communication bores extending therethrough and communicating said refrigerant suction chamber with said internal space formed within said head.

* * * * *